US006713702B1

(12) United States Patent
Lee

(10) Patent No.: US 6,713,702 B1
(45) Date of Patent: Mar. 30, 2004

(54) ELECTRICAL SWITCH

(75) Inventor: King-Long Lee, Hsin-Tien (TW)

(73) Assignee: Shin Jiuh Corp., Taipei Hsien (TW)

( * ) Notice: Subject to any disclaimer, the term of this patent is extended or adjusted under 35 U.S.C. 154(b) by 158 days.

(21) Appl. No.: 10/085,405

(22) Filed: Mar. 1, 2002

(51) Int. Cl.[7] ..... H01K 13/26
(52) U.S. Cl. ..... 200/520; 200/408; 200/461
(58) Field of Search ..... 200/405, 407, 200/408, 409, 440, 442, 449, 450, 451, 453, 459–461, 520

(56) References Cited

U.S. PATENT DOCUMENTS 3,270,156 A * 8/1966 Stewart ..... 200/408
4,904,832 A * 2/1990 Nagahara et al. ..... 200/402
5,459,295 A * 10/1995 Ohta et al. ..... 200/461
5,875,887 A * 3/1999 Tsai ..... 200/461

* cited by examiner

*Primary Examiner*—Michael Friedhofer
(74) *Attorney, Agent, or Firm*—Birch, Stewart, Kolasch & Birch, LLP

(57) ABSTRACT

An electrical switch comprises an assembly of a base and an upper cover. A conductor resilient plate is mounted in the switch with a resilient tongue that extends and bends toward the upper cover and is placed parallel with a push button on a same side of the conductor resilient plate. Thereby, the thickness of the upper cover and the base can be reduced, so the switch could be accommodated dimensionally electrical equipment.

2 Claims, 8 Drawing Sheets

ELECTRICAL SWITCH

FIELD OF THE INVENTION

The invention relates to an electrical switch. More particularly, the invention provides an electrical switch having a height that is at least half reduced in comparison with that the prior art.

BACKGROUND OF THE INVENTION

FIG. 1 is a sectional view illustrating a micro switch of the prior art, usually used in command output of mouse, keyboard, or power supply switch of electrical devices. As illustrated, the traditional micro switch principally comprises an assembly of a base 2*b* and an upper cover 1*b*. First and second insertion legs 3*b*, 4*b* are arranged through the base 2*b*. First and second positioning portions 31*b*, 32*b* are formed on the first insertion leg 3*b*. A hole 11*b* is defined through the upper cover 1*b*. A conductor resilient plate 5*b* is further mounted over the first and second insertion legs 3*b*, 4*b*. The plate 5*b* includes a first portion having a mounting part 51*b* mounted to the first positioning portion 31*b*, and a second portion provided with a contact pad 52*b* that is placed vis-à-vis the second insertion leg 4*b*. A resilient tongue 53*b*, integrally formed with the plate 5*b*, further extends and bends toward the base 2*b*, the tongue 53*b* having an end portion fastened to the second positioning portion 32*b*. A push button 6*b* is mounted over the plate 5*b* and is exposed through the hole 11*b*. When the user presses the push button 6*b*, the push button 6*b* consequently presses the plate 5*b*. With the mounting part 51*b* of the plate 5*b* electrically connected to the first insertion leg 3*b*, a pressing on the push button 6*b* thus causes an electrical contact of the contact pad 52*b* with the second insertion leg 4*b* by deflection of the plate 5*b*. An electrical switch having small contact deflection is hence traditionally constructed.

As illustrated in the drawings, mounting spaces have to be necessary left to allow pushing of the push button 6*b* and bending of the resilient tongue 53*b*. As a result, the height of the traditional switch (without the insertion legs 3*b*, 4*b*) is usually 7.3 mm. As electrical equipment become increasingly smaller, a traditional approach to accommodate the above electrical switch is to reduce the thickness of the upper cover 1*b* and the thickness of the base 2*b*. However, this approach negatively results in weakening the electrical switch, and causes cracks in the upper cover 1*b* or base 2*b* during product transportation or when the user pushes on the electrical switch. As the thickness of the base 2*b* or/and upper cover 1*b* is reduced, the switch further is more subject to deformation during injection molding or assembly in its fabrication process. As a result, the yield is negatively reduced.

Moreover, the above switch suffers another disadvantage. Because the resilient tongue 53*b* is positioned on the second positioning portion 32*b* by fitting, if only the plate 5*b* presents a defective deviation due to various fabrication deviations, the tongue 53*b* easily separates from the second positioning portion 32*b* after a certain time of utilization. Moreover, because the tongue 53*b* is proximate to the second insertion leg 4*b*, the tongue 53*b* when separated thus easily contacts with the second insertion leg 4*b*, thereby establishing an undesirable electrical contact.

SUMMARY OF THE INVENTION

It is therefore an object of the invention to provide an electrical switch that can overcome the above deficiencies and has a height that is dimensionally reduced a half.

To accomplish the above and other objectives, the electrical switch of the invention comprises a conductor resilient plate having a resilient tongue that extends and bends toward the upper cover and is placed parallel with the push button on a same side of the conductor resilient plate. Thereby, traditional mounting spaces are not required. Furthermore, even if the resilient tongue inadvertently separates from the second positioning portion, the resilient tongue would upwardly deviate and therefore would not causes an electrical contact with the second insertion leg. A secure control of the command output is thereby achieved.

In accordance with another aspect of the invention, the base of the electrical switch further includes a reinforcement integrally formed with the base by injection molding. By means of the reinforcement, the thickness of the base and/or the upper cover can be reduced without adversely weakening the electrical switch.

To provide a further understanding of the invention, the following detailed description illustrates embodiments and examples of the invention, this detailed description being provided only for illustration of the invention.

BRIEF DESCRIPTION OF THE DRAWINGS

The drawings included herein provide a further understanding of the invention. A brief introduction of the drawings is as follows.

DETAILED DESCRIPTION OF THE EMBODIMENTS

Figure 1:
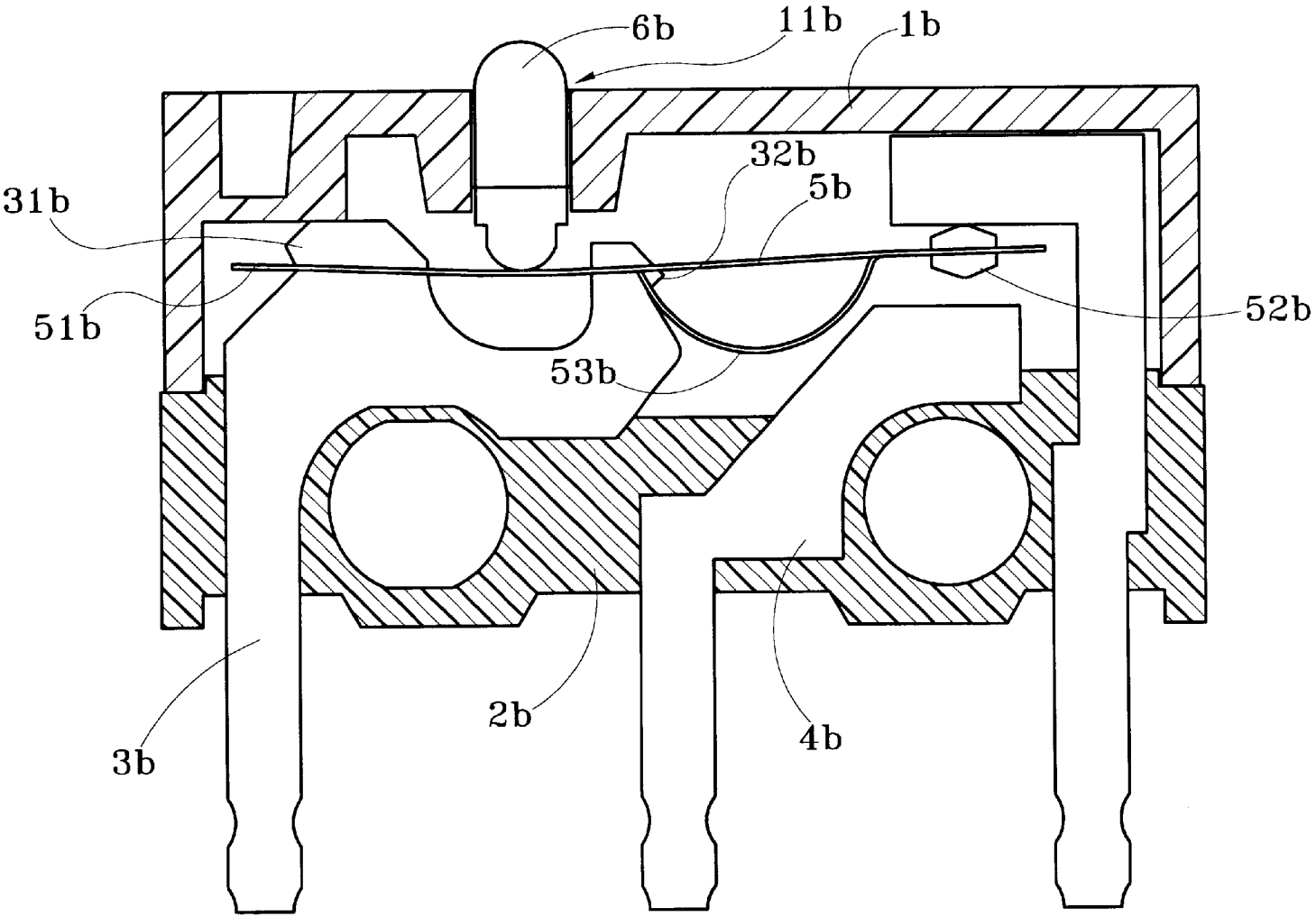
Fig.1 PRIOR ART
FIG. 1 is a sectional view illustrating an electrical switch of the prior art.

Wherever possible in the following description, like reference numerals will refer to like elements and parts unless otherwise illustrated.

Figure 2:
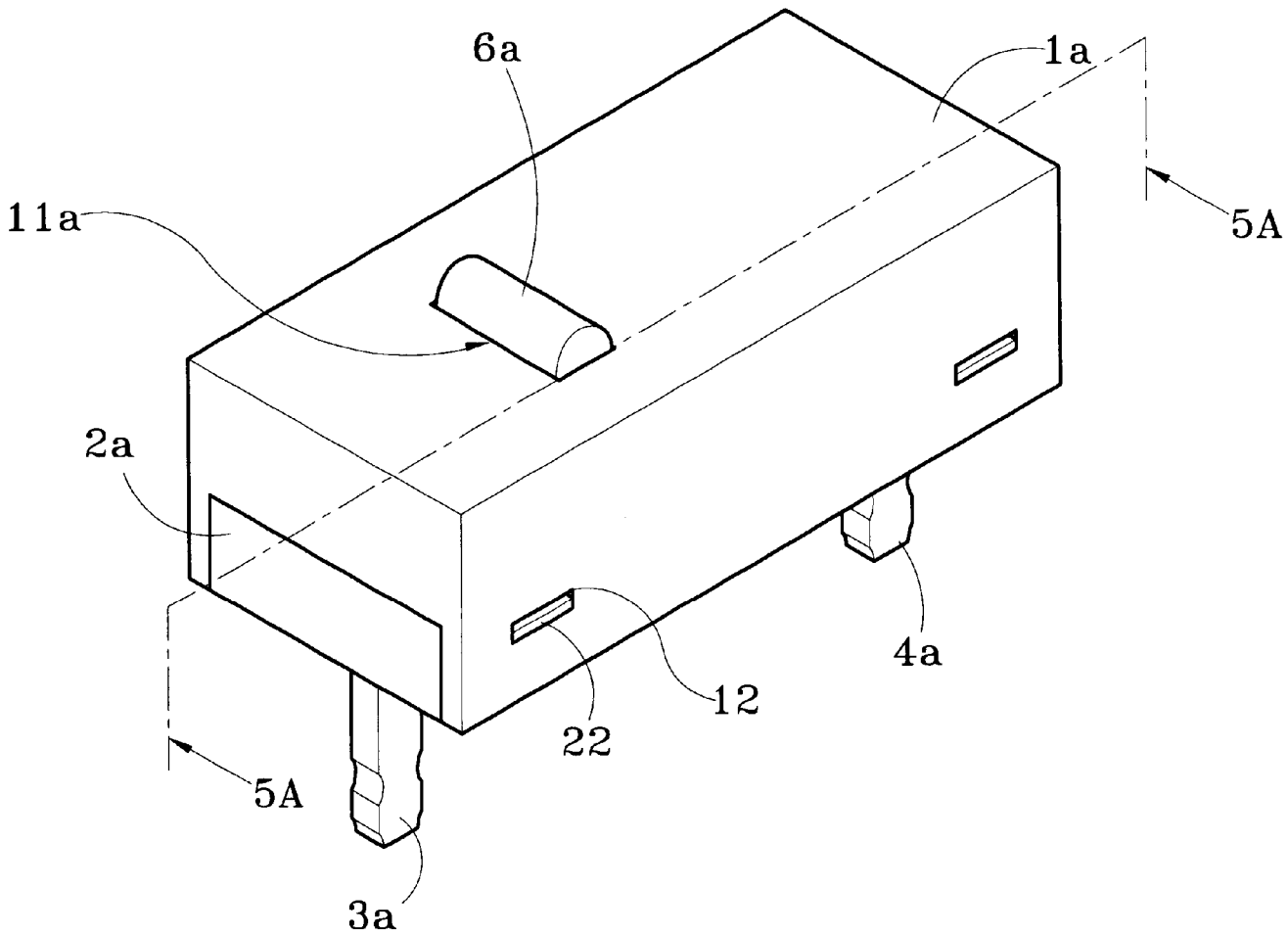
FIG. 2 is a perspective view of an electrical switch according to an embodiment of the invention.
Figure 3:
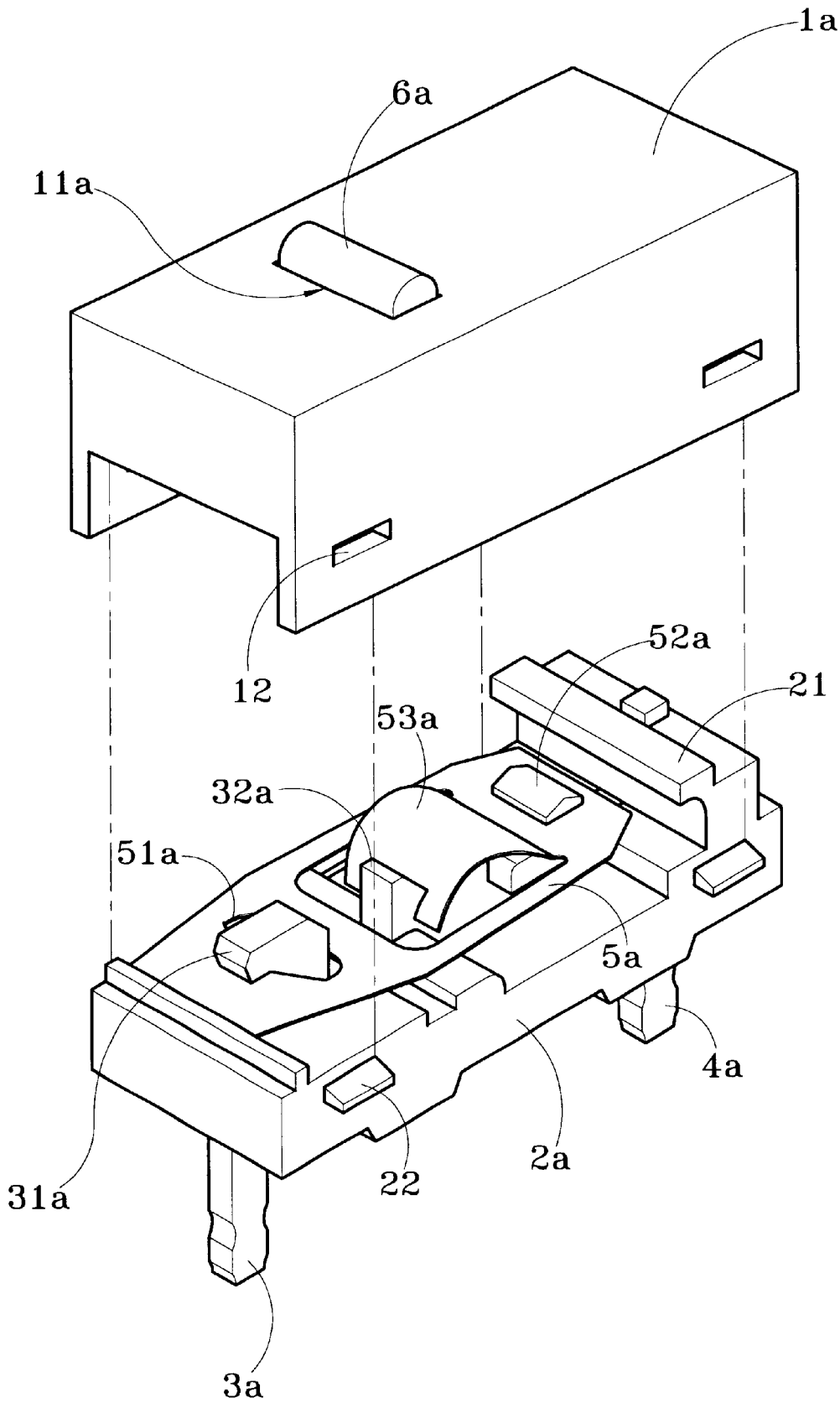
FIG. 3 and FIG. 4 are exploded views of an electrical switch according to an embodiment of the invention.
Figure 4:
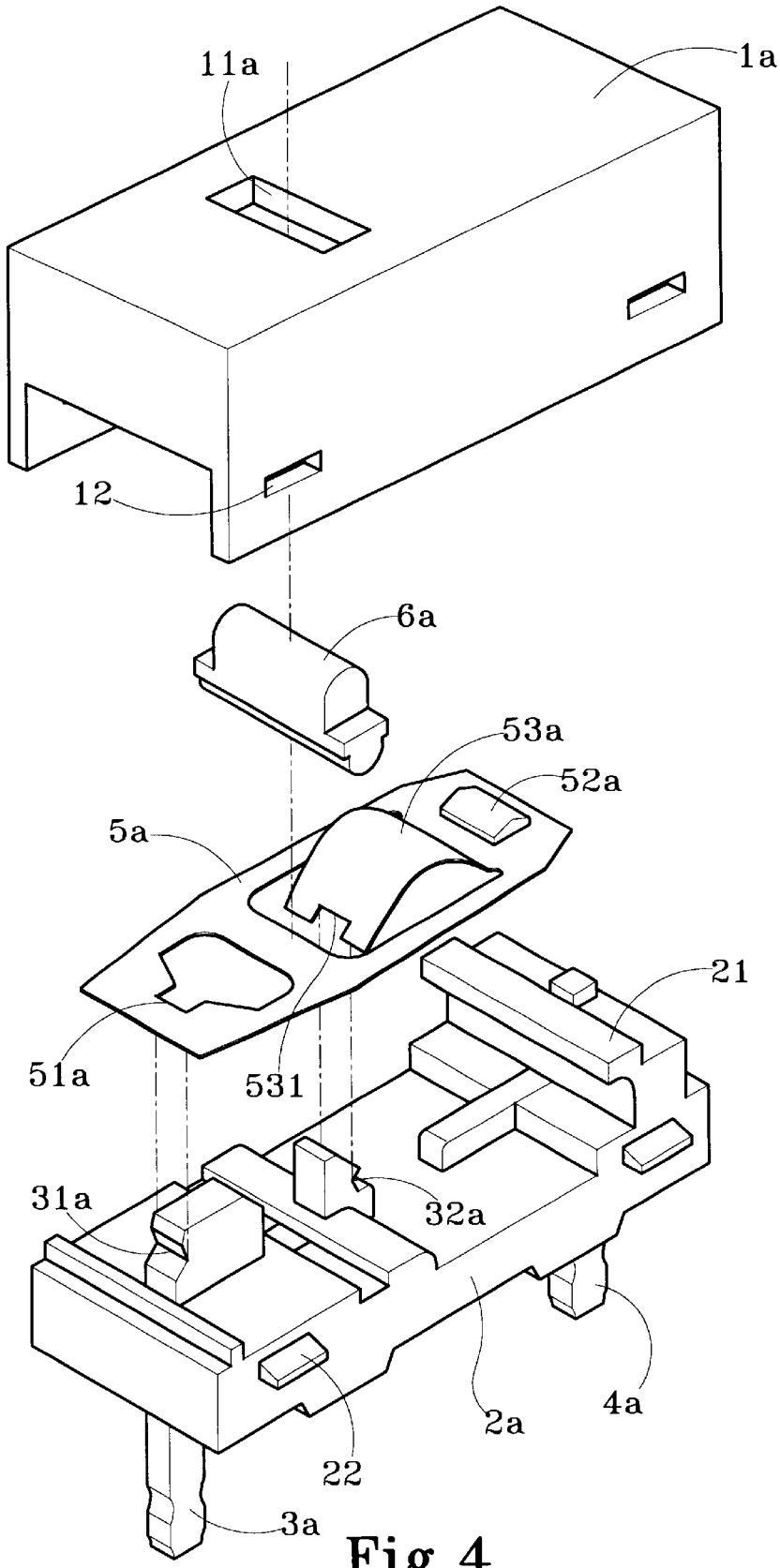

Referring to FIG. 2, FIG. 3, and FIG. 4, various perspective and exploded views illustrate an electrical switch according to an embodiment of the invention. As illustrated, the electrical switch comprises a base 2*a* and an upper cover 1*a* that assemble with each other. On sidewalls of the upper cover 1*a* and base 2*a* are respectively formed projections 22 and recessed portions 12 that correspondingly engage with one another. The base 2*a* is integrally formed by injection molding, and includes a reinforcement 21 projecting toward the upper cover 1*a*. Once the upper cover 1*a* and the base 2*a* are fastened to each other via the engagement of the projections 22 and the recessed portions 12, the reinforcement 21 supports and reinforces either the upper cover 1*a* or the base 2*a* that may be weakened due to a reduced thickness. First and second insertion legs 3*a*, 4*a* are further arranged through the base 2*a*. First and second positioning portions 31*a*, 32*a*, "<" shaped, are integrally formed on the first insertion leg 3*a*. A hole 11*a* is further defined through the upper cover 1*a*, and a conductor resilient plate 5*a* is mounted over the first and second insertions legs 3*a*, 4*a* within the base 2*a*. The plate 5*a* is provided with a mounting part 51*a* that fits the first positioning portion 31*a*, and a contact pad 52*a* is placed vis-à-vis the second insertion leg 4*a*. Integrally formed with the plate 5*a*, a resilient tongue 53*a* extends and bends toward the upper cover 1*a*. A notch 531 is defined at an end of the tongue 53*a* to be fastened to the second positioning portion 32*a*. The plate 5*a* is further provided with a push button 6*a* that is externally exposed through the hole 11*a*, enabling a pressing of the plate 5*a*.

By placing the resilient tongue 53*a* and the push button 6*a* on a same upper side of the plate 5*a*, the push button 6*a* being placed parallel to the tongue 53*a*, the height of the electrical switch can be substantially reduced. An electrical switch hence constructed can therefore satisfy the requirements of reduced mount space.

Figure 5A:
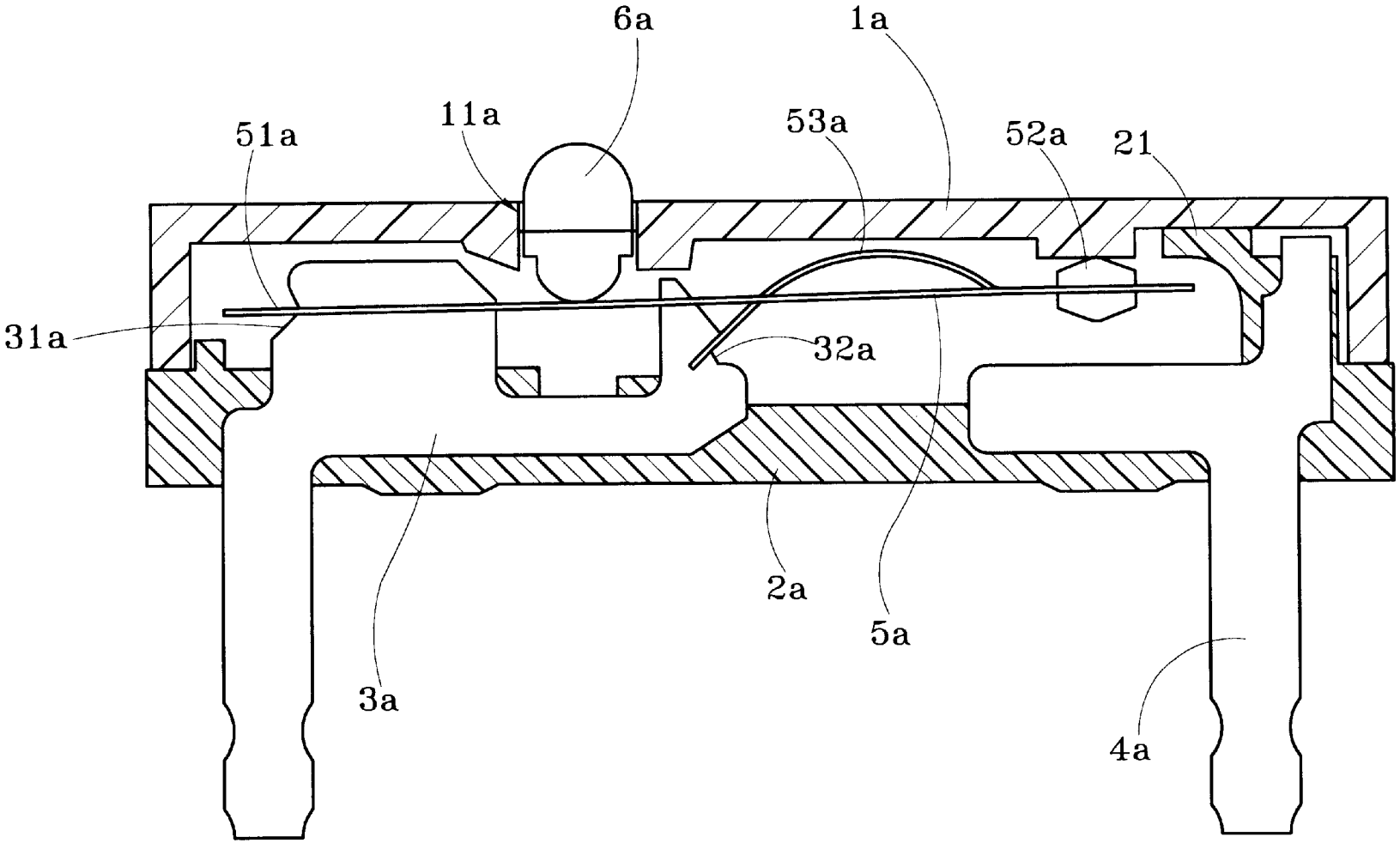
FIG. 5A is a sectional view taken along the section 5A—5A of FIG. 2.
Figure 5B:
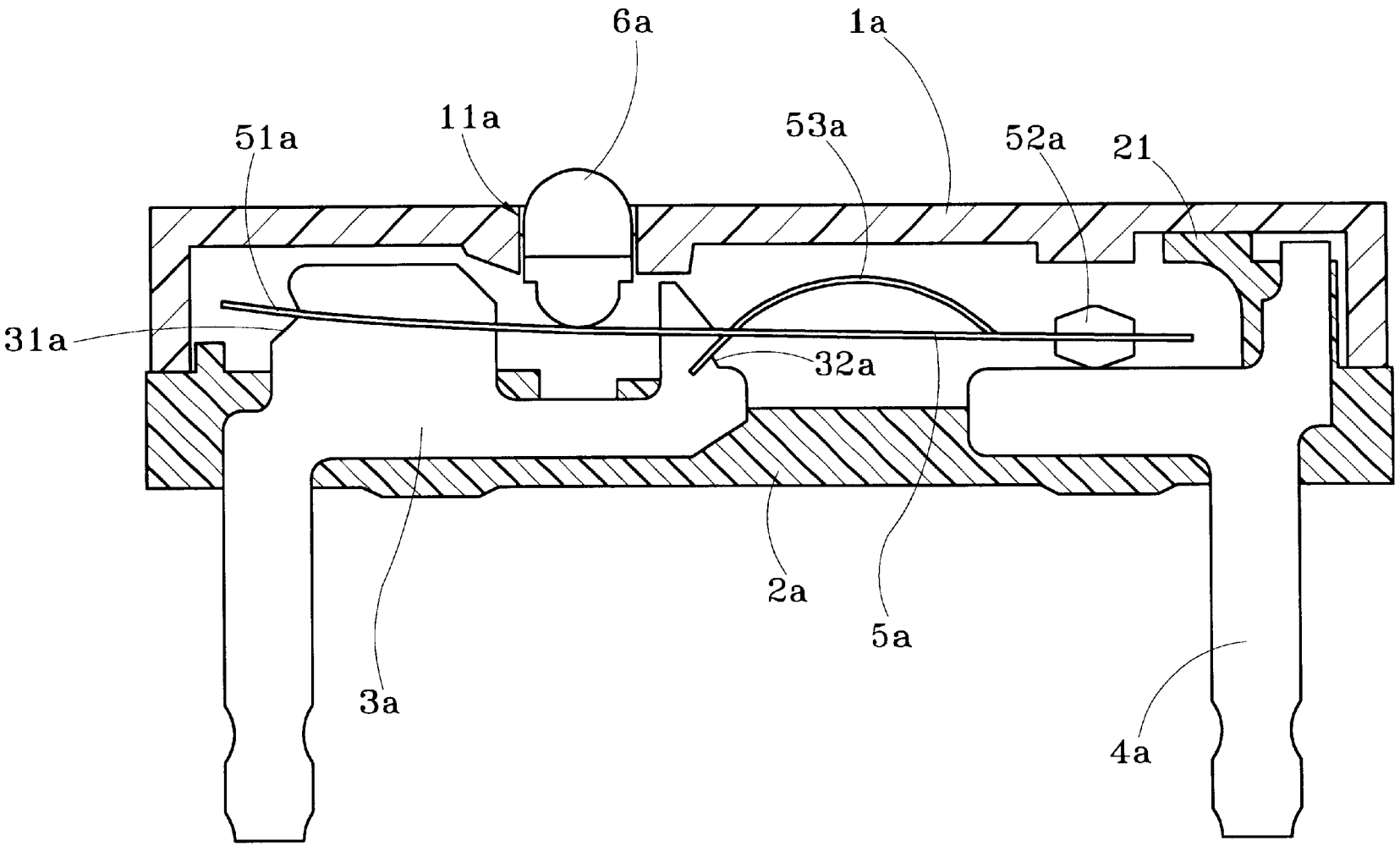
FIG. 5B is a sectional view showing the operation of the electrical switch.

Referring to FIG. 5A and FIG. 5B, two sectional views illustrate the operation of the electrical switch according to an embodiment of the invention. As illustrated, the mounting part 51*a* and the notch 531 are respectively positioned and mounted to the first and second positioning portions 31*a*, 32*a* (in order to accommodate the tongue 53*a*, the bending direction of the second positioning portion 32*a* differs from that of the prior art). In order to prevent any separating displacement before the upper cover 1*a* is mounted, an opposite end of the plate Sa extends below the reinforcement 21 of the base 2*a* to be thereby restrictedly positioned. Once the upper cover 1*a* is mounted to the base 2*a*, the user can turn the switch by pressing the push button 6*a*. The push button 6*a* consequently pushes the plate 5*a* that, via the rotation points respectively formed by the mount of the mounting part 51*a* to the first positioning portion 31*a* and the mount of the notch 531 to the second positioning portion 32*a*, deflects and causes the contact pad 52*a* to electrically contact with the second insertion leg 4*a*. The first and second insertion legs 3*a*, 4*a* are thereby electrically connected to each other.

As shown in the drawings, since the tongue 53*a* and the push button 6*a* are placed on a same side, the height of the switch can be favorably reduced. For reference, the height of the switch of the invention (without considering the insertion legs 3*a*, 4*a*) can be optimally 3.6 mm, which is about a half of the conventional switch height of 7.3 mm. The electrical switch of the invention can therefore satisfy the requirements of dimensional reduction. Furthermore, even if the tongue 53*a* inadvertently separates from the second positioning portion 32*a*, a consequent upward deviation of the tongue 53*a* will be restricted by the reinforcement 21, and inadvertent electrical contact with the second insertion leg 4*a* is thereby prevented. A secure control of the command output can be therefore achieved.

Figure 6:
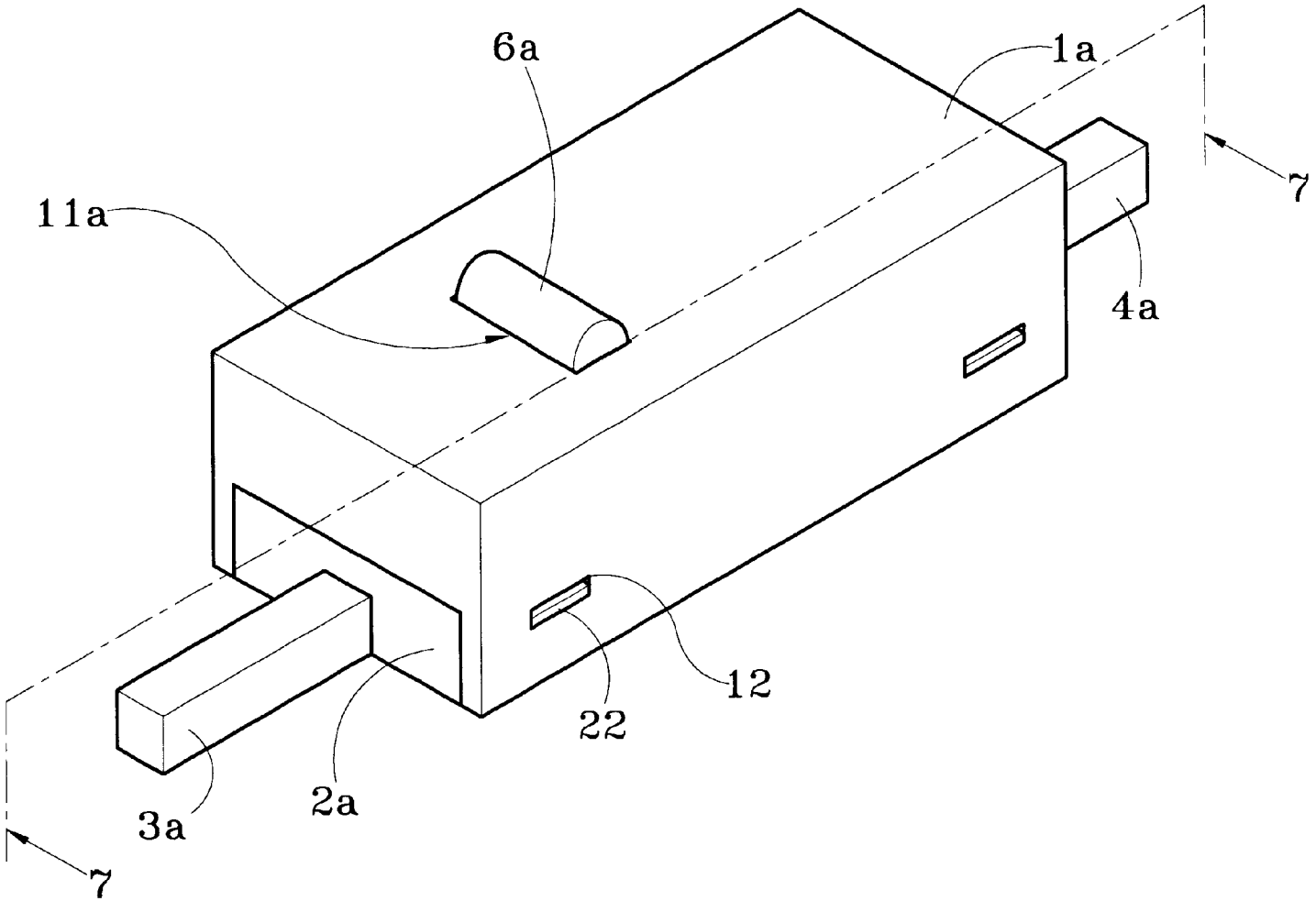
FIG. 6 is a perspective view of an electrical switch according to another embodiment of the invention.
Figure 7:
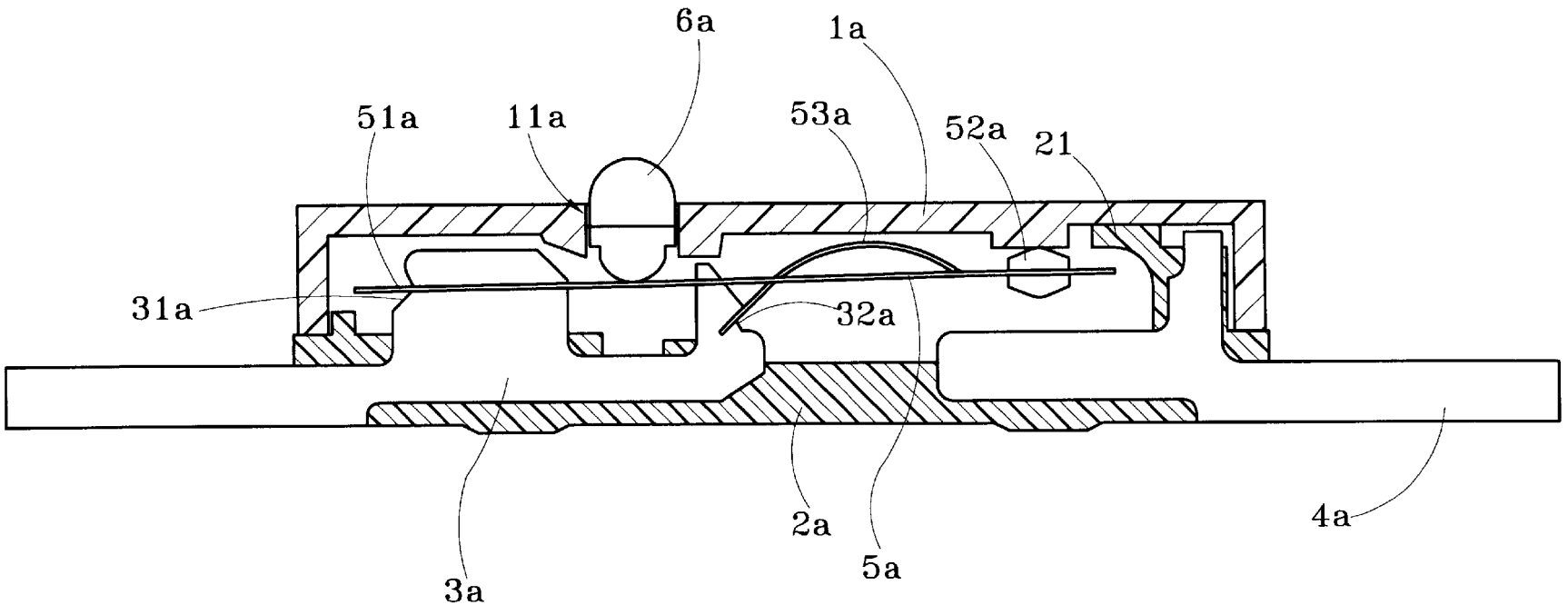
FIG. 7 is a sectional view taken along the section 7—7 of FIG. 6.

It should be apparent to those skilled in the art that the above description is only illustrative of specific embodiments and examples of the invention. For example, FIG. 6 and FIG. 7 are a perspective view and a sectional view that illustrate another variant embodiment of the invention where the first and second insertion legs 3*a*, 4*a* may be fabricated by SMT (surface mount technology).

What is claimed is:

1. An electrical switch comprising:

an assembly of a base and an upper cover, the base including a first and a second insertion leg being arranged there through, a first prositioning portion and a second positioning portion being further formed on the first insertion leg, the upper cover further including a hole; and a conductor resilient plate, including a first portion with a mounting part mounted to the first positioning portion, a second portion having a contact pad placed vis-à-vis the second insertion leg, and a resilient tongue extending and bending toward the upper cover and terminating in a notch mounted to the second positioning portion, wherein a push button is placed over the conductor resilient plate in a manner to be parallel with the resilient tongue on a same side of the conductor resilient plate, thereby reducing the height of the electrical switch, a reinforcement being integrally formed with the base by injection molding further extends toward the upper cover.

2. The electrical switch of claim 1, wherein a plurality of projections and a plurality of recessed portions are correspondingly formed on sidewalls of the base and the upper cover.

* * * * *